US008650684B1

(12) United States Patent
Mackinnon

(10) Patent No.: US 8,650,684 B1
(45) Date of Patent: Feb. 18, 2014

(54) SUPINE HEADREST WITH MANDIBULAR ENGAGING PORTION

(76) Inventor: Scott Mackinnon, Barrington, RI (US)

( * ) Notice: Subject to any disclaimer, the term of this patent is extended or adjusted under 35 U.S.C. 154(b) by 0 days.

(21) Appl. No.: 13/461,814

(22) Filed: May 2, 2012

(51) Int. Cl.
*A47C 20/00* (2006.01)

(52) U.S. Cl.
USPC ..... 5/640; 5/655.9; 5/637

(58) Field of Classification Search
USPC ..... 5/630, 636, 637, 638, 652, 655.9, 621, 5/622
See application file for complete search history.

(56) References Cited

U.S. PATENT DOCUMENTS 4,285,081 A * 8/1981 Price ..... 5/637
4,320,543 A * 3/1982 Dixon ..... 5/637
5,778,887 A * 7/1998 Curtiss ..... 128/845
6,305,749 B1 * 10/2001 O'Connor et al. ..... 297/397
6,460,207 B1 * 10/2002 Papay et al. ..... 5/640
7,331,631 B1 * 2/2008 Yeh ..... 297/391
7,451,507 B2 * 11/2008 Brinkerhoff et al. ..... 5/637
2010/0101024 A1 * 4/2010 Weisberg ..... 5/636

* cited by examiner

*Primary Examiner* — William Kelleher
*Assistant Examiner* — Duoni Pan
(74) *Attorney, Agent, or Firm* — Gulf Coast Intellectual Property Group

(57) ABSTRACT

An airway management pillow operable to provide a secure airway of a patient in a supine position by providing a combination of a head-tilt chin lift technique and a jaw thrust technique. The airway management pillow further includes a base having a contoured surface. Integrally formed with the base on opposing sides thereof are a pair of formable lateral wings. Disposed within the pair of lateral wings are lateral wing support members that are manufactured from a malleable metal. A plurality of mandible engaging members are formed with the pair of lateral wings that project inwards in a perpendicular manner and are operable to engage at least a portion of the posterior of the mandible of the patient engaged with the airway management pillow. A support frame is disposed within the base and is operably coupled with the lateral wing support members.

5 Claims, 2 Drawing Sheets

SUPINE HEADREST WITH MANDIBULAR ENGAGING PORTION

FIELD OF THE INVENTION

The present invention relates generally to a support pillow, more specifically but not by way of limitation a support pillow operable to provide support to a patient in a supine position, wherein the support pillow is configured to engage at least a portion of the posterior edge of the mandible so as to improve airway management of the patient.

BACKGROUND

Patient airway management is a critical component of a successful procedure such as but not limited to surgical procedure wherein the patient is under heavy sedation anesthesia or monitored anesthetic care. As is known in the art, airway management is the process of ensuring that an open pathway exists between a patient's lungs and an air source as well as ensuring aspiration of the lungs does not occur. In fields such as anesthesia airway management is a primary consideration. Additionally, in fields such as clinical care, airway management is a high priority. If the patient's airway becomes obstructed or airflow is less than optimal the oxygenation of the blood will diminish or cease.

There are several common procedures that are used to improve airway management and ensure that the airway is unobstructed. One procedure is commonly known as the head-tilt chin lift procedure. For those patients that do not have cervical spine injuries this is the simplest way of ensuring that a patient who is either sedated or unconscious has an open airway. Utilization of this procedure will lift the tongue from the back of the throat thereby substantially reducing the probability of airway blockage.

Another procedure known in the art is the jaw-thrust maneuver. In this procedure a practitioner will use their thumbs to push the posterior aspects of the mandible in a generally upward direction. As the mandible is displaced forward, the tongue is pulled forward thus substantially preventing the tongue from blocking the entrance to the trachea so as to ensure a secure airway.

It is typical during surgical procedures when patients are sedated under heavy sedation anesthesia or monitored anesthetic care to utilize at least one of the aforementioned procedures to maintain a secure airway. Typically a support pillow is utilized to inhibit the lateral movement of the patient's head and additionally attempt to maintain a favorable position for a secure airway. One problem with existing support pillows utilized on patients in a supine position is the lack of structural support therein so as to effectively maintain a desired position for a secure airway. Most surgical support pillows are manufactured from a gel or other polymeric material that is to conforming and fails to effectively maintain a desired position of the patient's head and neck. Furthermore, conventional surgical support pillows do not engage the posterior of the mandible so as to provide a jaw thrust as described above to add a method of maintaining a secure airway.

Accordingly, there is a need for an airway management support pillow that can be utilized in procedures such as but not limited to surgical procedures that provides substantially rigid support for the patient's head and neck while additionally engaging at least a portion of the posterior of the mandible.

SUMMARY OF THE INVENTION

It is the object of the present invention to provide a support pillow to be utilized in surgical procedures that positions the patient's head and neck so as to substantially maintain a secure airway for the patient during a surgical procedure.

Another object of the present invention is to provide a support pillow operable to maintain a secure airway for a patient in a supine position that has an undulated support surface operable to engage a portion of the head and neck of the patient.

Yet another object of the present invention is to provide a support pillow operable to maintain a secure airway for a supinely positioned patient that includes a base having a rigid frame disposed therein.

A further object of the present invention is to provide a support pillow operable to maintain a secure airway for a supine patient that includes a first lateral wing and a second lateral wing contiguous with and extending upward from the base.

Still another object of the present invention is to provide a support pillow operable to maintain a secure airway for a patient that further includes a malleable support structure extending into the first lateral wing and second lateral wing.

An additional object of the present invention is to provide a support pillow operable to position a patient so as to effectively maintain a secure airway wherein the malleable support structures are coupled with the rigid base.

Yet a further object of the present invention is to provide a support pillow operable to position a patient so as to substantially inhibit blockage of the patient's airway, wherein the first lateral wing and second lateral wing include a plurality of mandibular engaging projections.

Still another object of the present invention is to provide a support pillow that is operable to maintain a supine patient in a favorable position enabling a secure airway that is lightweight and comfortable.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
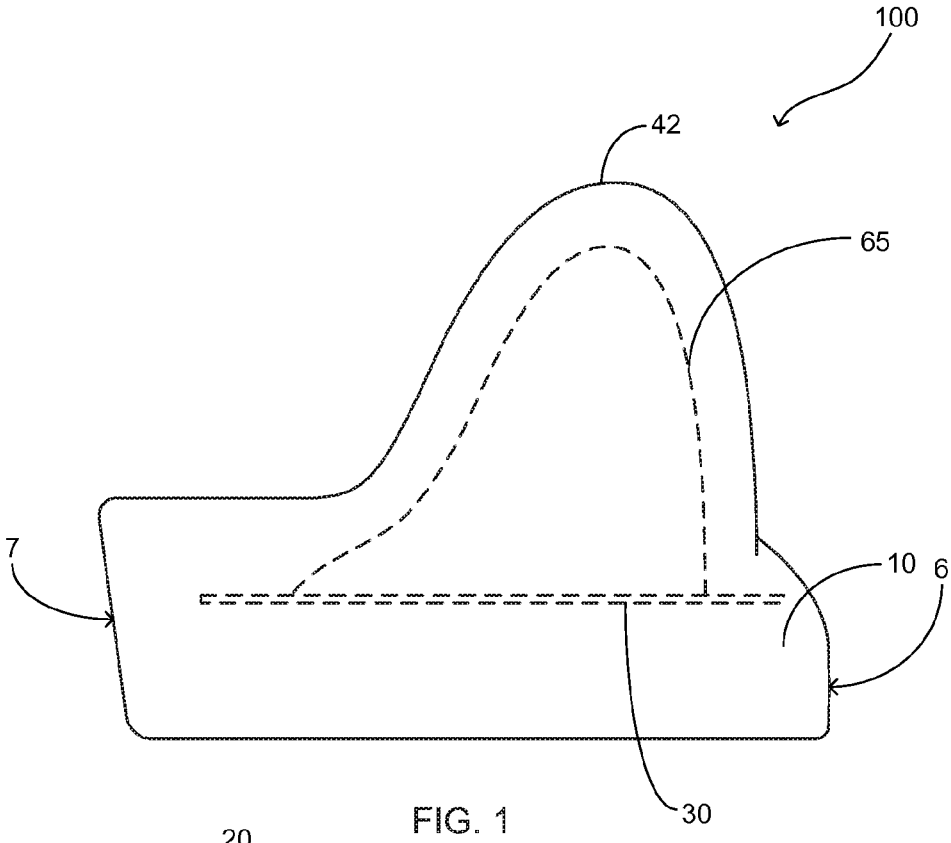
FIG. 1 is a side view of an embodiment of the present invention wherein the dotted lines illustrate the base frame and lateral wing frame disposed within the support pillow.

Referring now to the drawings submitted herewith, wherein various elements depicted therein are not necessarily drawn to scale and wherein through the views and figures like elements are referenced with identical reference numerals, there is illustrated a airway management pillow 100 constructed according to the principles of the present invention.

The airway management pillow 100 further includes a body 5 having base 10 that is modified rectangular in shape having a first end 6 and a second end 7 wherein the second end 7 is greater in width than the first end 6. The shape of the base 10 is designed to accommodate a human head and neck such that the first end 6 is narrower in order to laterally accommodate the neck of a patient engaged with the airway management pillow 100. The bottom 9 of the base 10 is generally flat in manner and is configured to be placed on a generally planar support surface such as but not limited to an operating table. The base 10 includes an upper surface 11 that is contoured in manner. The portion 13 of the upper surface 11 is elevated with respect to portion 15 of the upper surface. The contoured upper surface 11 aids in positioning a patient in a manner that provides head-tilt chin lift position so as to assist a practitioner in maintaining a secure airway for the patient engaged with the airway management pillow 100 wherein the patient is in a supine position. This combined with the lateral wings 20 discussed herein function to provide a superior airway management pillow 100. The base 10 is manufactured from a suitable durable material such as but not limited to a foam or polymeric material. It is contemplated within the scope of the present invention that the base 10 is manufactured from a material that provides patient comfort but less conformance in order to assist in the maintaining of the desired head-tilt chin-lift position for the patient. Those skilled in the art will recognize that numerous materials could be utilized to manufacture the base 10. It is contemplated within the scope of the present invention that the base 10 is covered with a coating or material to provide additional safety or antibacterial features and additionally be impervious to fluids. While the base 10 is disclosed herein as being modified rectangular in shape, it is contemplated within the scope of the present invention that the base 10 could be formed in numerous other shapes and perform the desired functionality as described herein.

Contiguously formed with the base 10 and the upper surface 11 is the end member 25. The end member 25 is manufactured from the same material as the base 10 and forms a perimeter proximate second end 7 so as to inhibit the movement of the patient's head in a longitudinal direction subsequent the patient engaging the airway management pillow 100. The end member 25 extends laterally across the entire base 10 having an arcuate inner edge 24 and is contiguously formed with the lateral wings 20 proximate ends 26, 27. While no particular height is required for the end member 25, good results have been achieved utilizing a height of approximately three to four inches.

Contiguously formed with the base are the lateral wings 20. A first lateral wing 40 and a second lateral wing 45 are located on opposing sides of the airway management pillow 100. The lateral wings 20 are formed such that their position is more proximate the first end 6. This construction facilitates the proper placement of the mandible engaging members 70. The lateral wings 20 are formable in a lateral direction as will be discussed further herein. The lateral wings 20 project upward from the base 10 and have a curved outer perimeter edge 42. The lateral wings 20 are manufactured from the same material as the base 10 and include a coating and/or outer surface similar to that of the base 10. Integrally formed with the lateral wings 20 are a plurality of mandible engaging members 70. The mandible engaging members 70 project in a generally perpendicular and inward direction from the inner surface 31 of the lateral wings 20. The mandible engaging members 70 are manufactured from a suitable durable material that is non-conformant to the pressure of a patient's jaw. The mandible engaging members 70 extend in a general horizontal manner across the inner surface 31 so as to assist in the proper engagement of the posterior of the patient's mandible. The mandible engaging members 70 are positioned so as to engage at least a portion of the posterior edge of the patient's mandible. The engagement of the patient's mandible with the mandible engaging members 70 provides a jaw thrust to the patient. This jaw thrust in combination with the head-tilt chin-lift provided by the base 10 further improves the management of a secure airway by the airway management pillow 100. It is desirable that the material utilized to manufacture the mandible engaging members 70 is non-conformant as the use of conformant material would reduce the force applied by the mandible engaging member 70 to the posterior of the mandible and potentially compromise the force applied to the posterior of the patient's mandible and risk the loss of a secure airway for the patient.

As illustrated herein, each lateral wing 20 includes three mandible engaging members 70 arranged in a generally vertical manner having spaces intermediate thereto. The utilization of more than one mandible engaging member 70 arranged in the aforementioned manner provides the practitioner utilizing the airway management pillow 100 greater flexibility in accommodating patients of various sizes and allows the practitioner to position the lateral wings 20 in order to engage the patient's mandible with the mandible engaging members 70 that provide the desired jaw thrust. While the airway management pillow 100 in its preferred embodiment has more than one mandible engaging member 70 on each lateral wings 20, it is contemplated within the scope of the present invention that each lateral wing 20 could have as few as one mandible engaging member 70.

Figure 2:
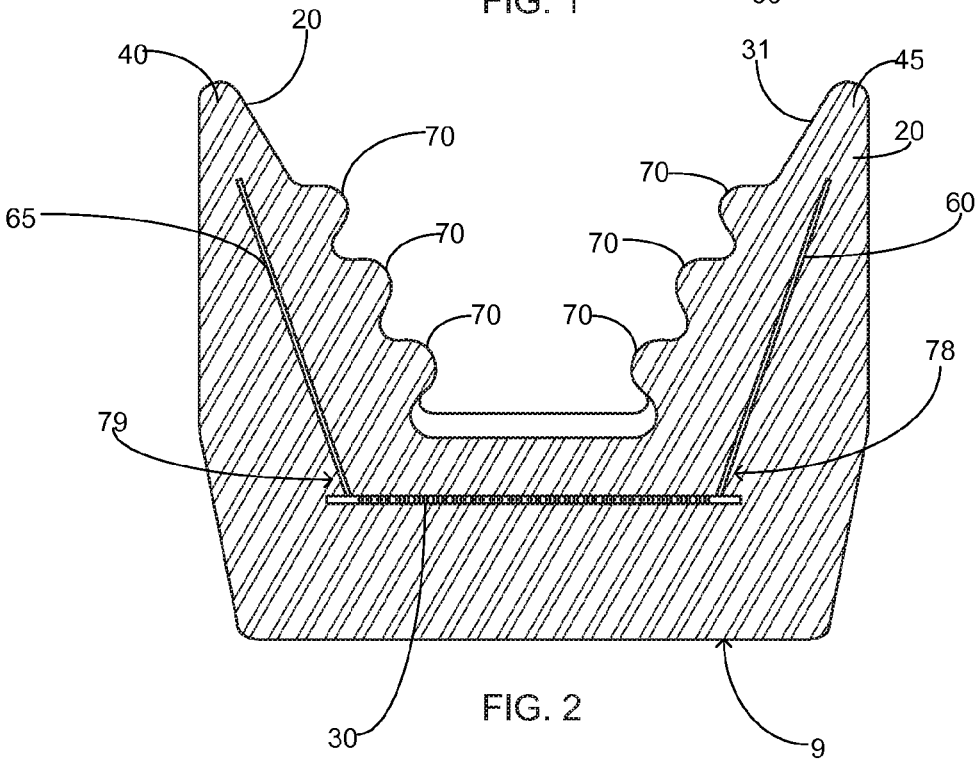
FIG. 2 is a cross-sectional end view of an embodiment of the present invention.

As shown in particular in FIGS. 1 and 2, disposed within the base 10 is the support frame 30. The support frame 30 is constructed of a durable rigid material such as but not limited to metal. The support frame 30 extends substantially the length of the base 10 and is similarly shaped to the base 10. The support frame 30 is positioned within the base 10 wherein the support frame 30 is more proximate the upper surface 11 as opposed to the bottom 9. This positioning aids in the rigidity of structural support for the lateral wing support members 60, 65. In the aforementioned position, the structural support provided to the lateral wing support members 60, 65 is improved as opposed to having the support frame 30 in a position such that it is more proximate the bottom of the base 10. The latter mentioned position would increase the length required for the lateral wing support members 60,65, thus weakening the structure. The support frame 30 is generally planar in manner and while no thickness is required, good results have been achieved utilizing a support frame 30 that is approximately one quarter of an inch to one-third of an inch in thickness. This thickness allows for sufficient structural support while minimizing the weight of the support frame 30. It is also contemplated within the scope of the present invention that the support frame 30 could be manufactured in a honeycomb manner. This design would provide the structural support needed but reduce the weight of the support frame 30.

Illustrated in particular in FIGS. 1 and 2 are the lateral wing support members 60,65. The lateral wing support members 60, 65 are secured proximate lower ends 78,79 to opposing sides of the support frame 30. The lateral wing support members 60, 65 are secured to the support frame utilizing suitable durable techniques such as but not limited to welding. The lateral wing support members 60, 65 extend substantially into the lateral wings 20 and are generally planar in manner being of similar shape to the lateral wings 20. Utilizing the configuration wherein the lateral wing support members 60,65 are of similar shape to the lateral wings 20 provides greater structural support than an alternative shape or configuration. The lateral wing support members 60, 65 are manufactured from a durable and malleable material. The malleability of the lateral wing support members 60,65 provides an important feature of the airway management pillow 100. The ability to laterally maneuver (inward-outward) the lateral wings 20 allows the practitioner to manipulate the airway management pillow 100 so as to accommodate a greater range of patient size. The formable lateral wings 20 facilitate the proper placement of the mandible engaging members 70 on any patient that is engaged with the airway management pillow 100. While the lateral wings 20 are formable, the lateral wings 20 are configured so as to be generally immovable by the weight and force of a patient's head and neck so as not to compromise the desired position of the patient. Those skilled in the art will recognize that numerous types of malleable metal could be utilized to manufacture the lateral wing support members 60, 65. Additionally, it is further contemplated within the scope of the present invention that the lateral wings 20 could be manufactured such that they are formable as described herein utilizing several other techniques and/or materials.

Figure 3:
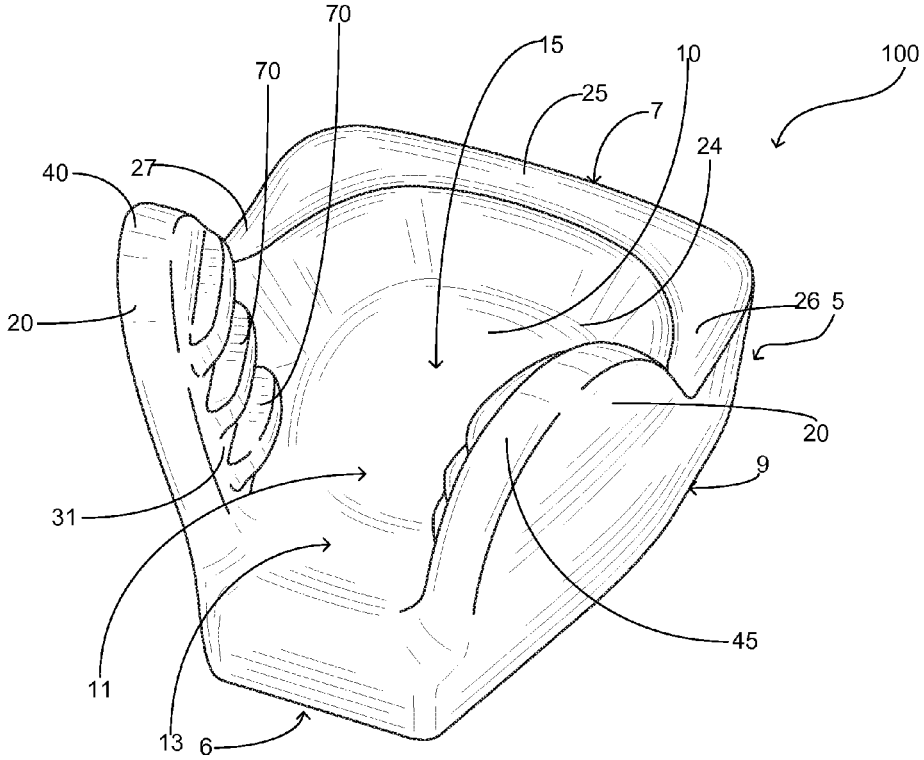
FIG. 3 is a perspective view of an embodiment of the present invention.
Figure 4:
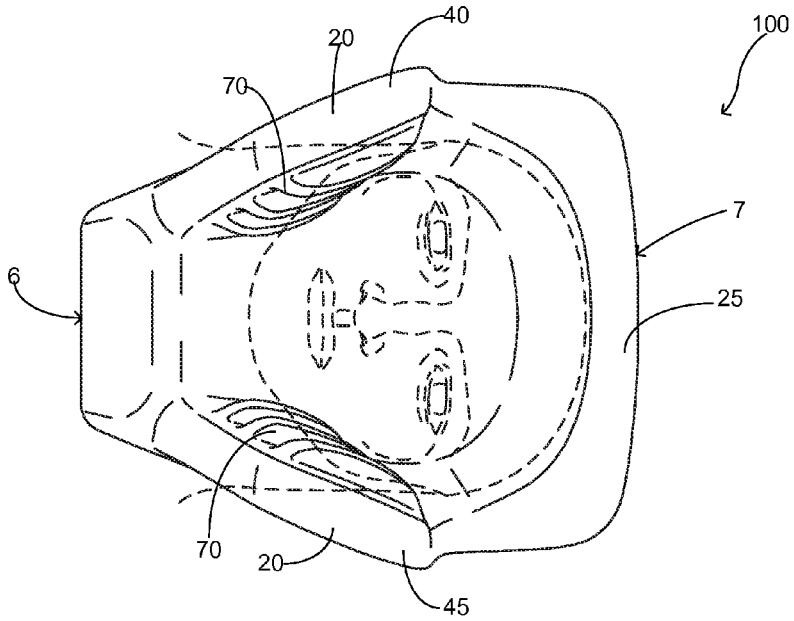
FIG. 4 is a top view of the present invention with a patient engaged therewith.

Referring in particular to FIGS. 2 and 3, a description of the operation of the airway management pillow 100 is as follows. In use, a practitioner will place the airway management pillow on an appropriate horizontal support structure designed to accommodate a patient in a supine position. The practitioner will position the patient such that the head of the patient is superposed the upper surface 11 of the base 10 proximate portion 15. As discussed herein the contour of the upper surface provides a head-tilt chin lift position so as to begin to provide a secure airway. Subsequent the patient's head being superposed the base 10, the practitioner will manipulate the lateral wings 20 inward towards the patient so as to position the lateral wings 20 such that at least one of the mandible engaging members 70 formed with each lateral wing 20 engages at least a portion of the posterior edge of the patient's mandible so as to provide a jaw thrust enabling an improved and more secure airway for the patient.

While the airway management pillow 100 has been disclosed herein in a preferred embodiment for the managing of a secure airway for a patient, it is further contemplated within the scope of the present invention that the airway management pillow 100 could be utilized to treat snoring or other sleeping conditions that could be improved by reducing the obstructions of an airway.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An airway management apparatus operable to provide a secure airway for a patient in a supine position by providing a combination of a head-tilt chin lift and jaw thrust airway management techniques comprising:

a base, said base being modified rectangular in shape, said base having a first end and a second end, said second end being greater in width than said first end, said base having a bottom that is planar in manner, said base having a first side and a second side, said base further including an upper surface, said upper surface of said base having a first portion and a second portion, said second portion being lower than said first portion, said second portion operable to receive a patient's head, wherein the shape of the upper surface of said base is operable to provide a head-tilt chin lift airway management technique to a patient engaged with the airway management apparatus;

a first lateral wing, said first lateral wing being integrally formed with said base, said first lateral wing being mounted to said first side of said base, said first lateral wing extending upward from said base, said first lateral wing having an interior surface, said first lateral wing configured to be laterally adjustable;

a second lateral wing, said second lateral wing being integrally formed with said base, said second lateral wing being mounted to said second side of said base, said second lateral wing extending upward from said base, said second lateral wing having an interior surface wherein said interior surface of said second lateral wing is generally facing said interior surface of said first lateral wing, said second lateral wing configured to be laterally adjustable;

a support frame, said support frame being disposed within said base, said support frame being planar in manner, said support frame being of similar size and shape to said base, said support frame having a first end and a second end, said support frame having a first side and a second side; and a plurality of mandible engaging members, said plurality of mandible engaging members being integrally formed with the interior surface of said first lateral wing and said second lateral wing, said plurality of mandible engaging members being manufactured from a non-conformant material, said plurality of mandible engaging members extending substantially across the width of said first lateral wing and said second lateral wing in a horizontal manner, said plurality of mandible engaging members being generally perpendicular with said first lateral wing and said second lateral wing and wherein one of said plurality of mandible engaging members on said first lateral wing and said second lateral wing are operable to engage at least a portion of the posterior edge of a patient's mandible subsequent the patient being received into the airway management apparatus so as to provide a jaw thrust airway management technique.

2. The airway management apparatus as recited in claim 1, and further including a first lateral wing support member, said first lateral wing support member having a first end and a second end, said first end of said first lateral wing support member being secured to said first side of said support frame, said first lateral wing support member extending substantially into said first lateral wing, said first lateral wing support member being manufactured from a malleable metal so as to enable the lateral movement of said first lateral wing.

3. The airway management apparatus as recited in claim 2, and further including a second lateral wing support member, said second lateral wing support member having a first end and a second end, said first end of said second lateral wing support member being secured to said second side of said support frame, said second lateral wing support member extending substantially into said second lateral wing, said second lateral wing support member being manufactured from a malleable metal so as to enable the lateral movement of said second lateral wing.

4. The airway management apparatus as recited in claim 3, wherein said plurality of mandible engaging members are arranged in a vertical stacked manner on the interior surface of said first lateral wing and said second lateral wing, said mandible engaging members having a space intermediate an adjacent mandible engaging member.

5. The airway management apparatus as recited in claim 4, and further including a perimeter member, said perimeter member being integrally formed with said base, said perimeter member extending upward from said base, said perimeter member operable to engage a top portion of a patient's head.

* * * * *